US007442889B2

(12) United States Patent
Lee et al.

(10) Patent No.: US 7,442,889 B2
(45) Date of Patent: Oct. 28, 2008

(54) KEYPAD ASSEMBLY

(75) Inventors: Joo-Hoon Lee, Yongin-si (KR); Sun-Tae Jung, Anyang-si (KR)

(73) Assignee: Samsung Electronics Co., Ltd., Yeongtong-Gu, Suwon-Si, Gyeonggi-Do (KR)

( * ) Notice: Subject to any disclaimer, the term of this patent is extended or adjusted under 35 U.S.C. 154(b) by 0 days.

(21) Appl. No.: 11/473,193

(22) Filed: Jun. 21, 2006

(65) Prior Publication Data

US 2007/0007118 A1 Jan. 11, 2007

(30) Foreign Application Priority Data

Jul. 6, 2005 (KR) ..... 10-2005-0060806

(51) Int. Cl.
*H01H 13/00* (2006.01)

(52) U.S. Cl. ..... 200/314; 200/512

(58) Field of Classification Search ..... 200/310–314, 200/317, 341, 5 A, 5 R, 512–517, 520; 400/472, 400/490–496

See application file for complete search history.

(56) References Cited

U.S. PATENT DOCUMENTS 4,124,879 A * 11/1978 Schoemer ..... 200/314
5,083,240 A * 1/1992 Pasco ..... 362/26
5,128,842 A * 7/1992 Kenmochi ..... 200/314
5,401,927 A * 3/1995 Lundell et al. ..... 200/314
5,432,684 A * 7/1995 Fye et al. ..... 200/314
5,521,342 A * 5/1996 Bartley et al. ..... 200/5 A
5,975,711 A * 11/1999 Parker et al. ..... 200/314

FOREIGN PATENT DOCUMENTS

WO WO 2005019367 A1 * 3/2005

* cited by examiner

*Primary Examiner*—Elvin Enad
*Assistant Examiner*—Marina Fishman
(74) *Attorney, Agent, or Firm*—Cha & Reiter, LLC

(57) ABSTRACT

A keypad assembly including a light guide plate, a keypad, and reflective layers is disclosed. The light guide plate includes reflective patterns that are locally formed on the bottom surface of the light guide plate to reflect a part of light going into the light guide plate to the top surface of the light guide plate. The keypad includes a pad that is in the shape of a box whose bottom is opened by sidewalls and surrounds the remaining portions of the light guide plate except for the bottom surface of the light guide plate and at least one key button placed on the top surface of the pad and outputting light reflected from the reflective patterns to their outside. The reflective layers are formed at the sidewalls of the pad facing the sides of the light guide plate to reflect light irradiated from the sides of the light guide plate back to the sides of the light guide plate.

7 Claims, 5 Drawing Sheets

KEYPAD ASSEMBLY

CLAIM OF PRIORITY

This application claims priority under 35 U.S.C. § 119 to an application entitled "Keypad Assembly," filed in the Korean Intellectual Property Office on Jul. 6, 2005 and assigned Ser. No. 2005-60806, the contents of which are incorporated herein by reference.

BACKGROUND OF THE INVENTION

1. Field of the Invention

The present invention generally relates to a keypad assembly, and in particular, to a keypad assembly including a light guide plate.

2. Description of the Related Art

A conventional keypad assembly used in portable terminals generally includes a keypad and a switch board. The keypad includes an elastic layer in a plate form and a plurality of key buttons formed on a first surface of the elastic layer. The key buttons may have characters, numbers or symbols printed thereon. In the switch board, a plurality of switches is used to form electric contact by pressing a key button to convert the press of the key button into an electric signal.

Portable terminals may include an illumination means capable of emitting light. This allows for the use of a keypad even in a dark place. In the illumination means, a plurality of light emitting diodes are arranged on a printed circuit board (PCB) or an inorganic electro-luminescence material may be inserted into an elastic pad.

FIG. 1 illustrates the structure of a conventional keypad assembly. The conventional keypad assembly includes a pad 112, a key button 111 formed on the pad 112, a keypad 110 including a light guide plate 113 under the pad 112, a light source (not shown) for irradiating light from a side of the light guide plate 113 into the light guide plate 113, and a switch board 120.

The switch board 120 includes at least one dome switch 121 and a PCB 122 on whose surface the dome switch 121 is formed. An electric contact between the dome switch 121 and the PCB 122 can be formed by pressing the key button 111.

The keypad 110 may be combined with the key button 111 and the pad 112 may be integrated in one body or separately formed. The pad 112 may be made of rubber having elasticity to restore the key button 111 to its original state upon the release of the pressure applied by a user.

In the light guide plate 113, a pressing protrusion 113*a* is formed in a position corresponding to the dome switch 121. Reflective patterns 113*b* for reflecting a part of the light irradiated into the light guide plate 113 to the key button 111 are formed around the pressing protrusion 113*a*. A part of the light irradiated into the light guide plate 113 is reflected to the key button 111 by the reflective patterns 113*b* and the remaining of the light is irradiated from another side of the light guide plate 113.

However, the light irradiated from the side of the light guide plate 113 illuminates not only the key button 111 but other portions of the assembly as well. This causes loss of light and may distract the user's eyes from the key button 111.

SUMMARY OF THE INVENTION

One aspect of the present invention relates to a keypad assembly capable of minimizing a loss of light and preventing user's eyes from being distracted by preventing light from being irradiated from a side of a light guide plate.

One embodiment of the present invention is directed to a keypad assembly including a light guide plate, a keypad, and reflective layers. The light guide plate includes reflective patterns that are locally formed on the bottom surface of the light guide plate to reflect a part of light going into the light guide plate to the top surface of the light guide plate. The keypad includes a pad which is in the shape of a box whose bottom is opened by sidewalls and surrounds the remaining portions of the light guide plate except for the bottom surface of the light guide plate and at least one key buttons placed on the top surface of the pad and outputting light reflected from the reflective patterns to their outside. The reflective layers are formed at the sidewalls of the pad facing the sides of the light guide plate to reflect light irradiated from the sides of the light guide plate back to the sides of the light guide plate.

BRIEF DESCRIPTION OF THE DRAWINGS

The above and other aspects, features and embodiments of the present invention will become more apparent from the following detailed description when taken in conjunction with the accompanying drawings in which.

DETAILED DESCRIPTION

Embodiments of the present invention will now be described in detail with reference to the annexed drawings. For the purposes of clarity and simplicity, a detailed description of known functions and configurations incorporated herein has been omitted for conciseness.

Figure 1:
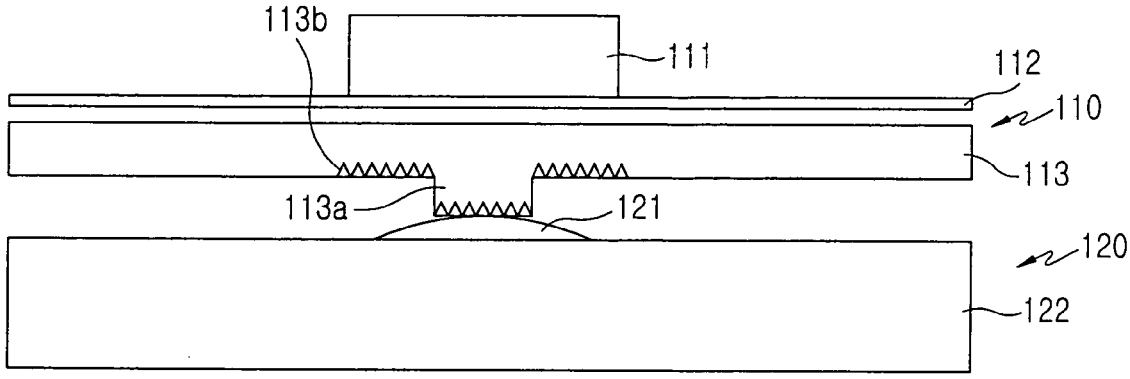
FIG.1 (PRIOR ART)
FIG. 1 illustrates a conventional keypad assembly.
Figure 2:
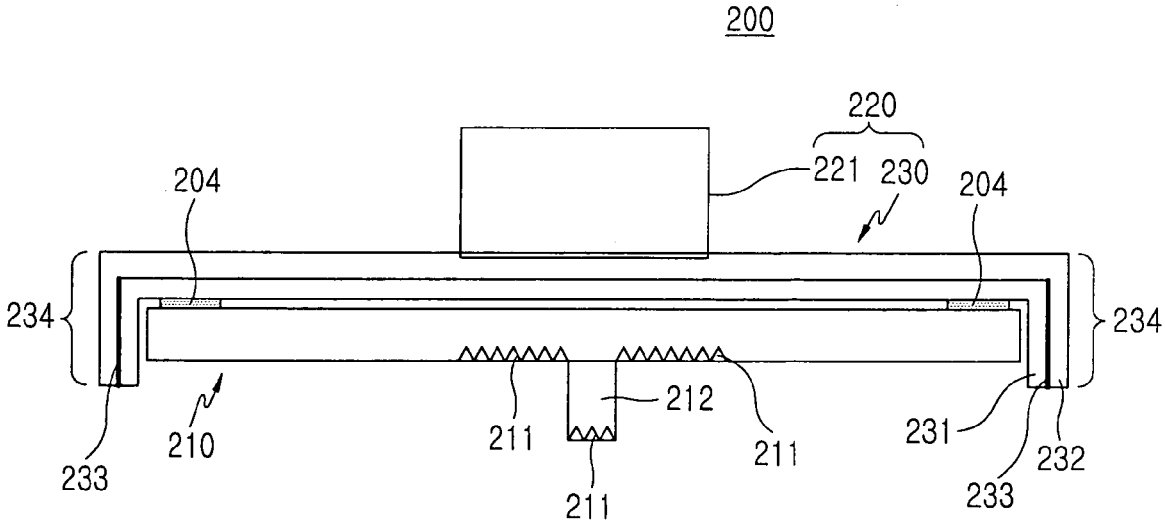
FIG. 2 is a cross-sectional view of a keypad assembly according to a first embodiment of the present invention.
Figure 3:
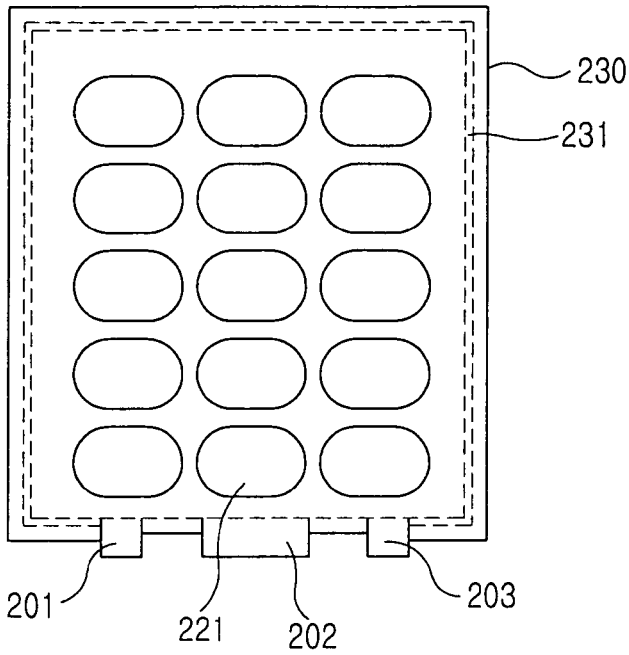
FIG. 3 is a plane view of the keypad assembly of FIG. 2 in view of key buttons.

FIG. 2 is a cross-sectional view of a keypad assembly 200 according to a first embodiment of the present invention. FIG. 3 is a plane view of the keypad assembly of FIG. 2 in view of key buttons. The keypad assembly 200 includes a keypad 220, a light guide plate 210, and an adhesive 204. One or more edge emitting light sources 201 through 203 are combined to a side of the light guide plate 210. Light emitting diodes may be used for the light sources 201 through 203.

The keypad 220 includes sidewalls 234 extending downward, a pad 230 in the shape of a box whose bottom is opened, reflective layers 233 formed at the sidewalls 234, and at least one key button 221 placed on the pad 230.

The pad 230 includes a polyurethane layer 232 having elasticity for restoring the pressed key button 221 to its original state. A silicon layer 231 is formed in the inner side of the polyurethane layer 232.

The key button 221 is placed on the pad 230 in the shape of a flat plate. Parts of the sidewalls 234 are opened and the light sources 201 through 203 and the light guide plate 210 are combined at the opened parts. The reflective layers 233 face sides of the light guide plate 210 and reflect light irradiated from the sides of the light guide plate 210 back to the light guide plate 210.

Figure 4:
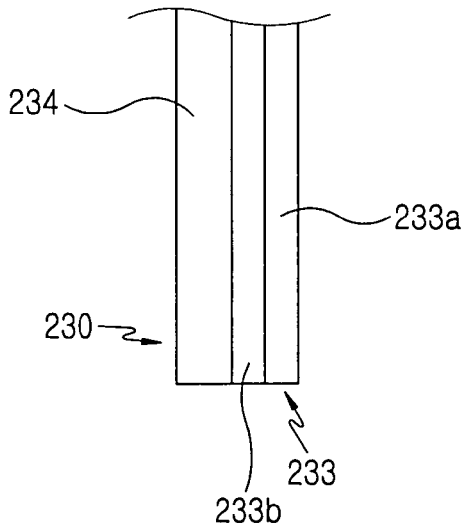
FIG. 4 is an enlarged view of a portion of a reflective layer of FIG. 2.

FIG. 4 is an enlarged view of a portion of the reflective layer 233 of FIG. 2. Referring to FIG. 4, the reflective layer 233 includes a white printed layer 233*a* facing a side of the light guide plate 210 and a black printed layer 233*b* formed between the white printed layer 233*a* and the sidewall of the pad 230. The reflective layers 233 are formed by printing and may be attached or formed using a separate film or through additional coating if necessary.

The white printed layer 233*a* reflects the light irradiated from a side of the light guide plate 210 back to the light guide plate 210, and the black printed layer 233*b* absorbs a part of light passing through the light guide plate 210 and the white printed layer 233*a* to prevent light from being leaked to outside of the keypad assembly 200.

The key button 221 has characters, symbols or numbers printed thereon. The key button 221 may be formed of a material that is the same as or different from that of the pad 230 or of polycarbonate or acryl-based resin and then attached onto the pad 230. The key button 221 may have various shapes such as circles, ovals, squares or other polygons.

The light guide plate 210 has a top surface and a bottom surface parallel to each other and facing each other and includes pressing protrusions 212 on its bottom surface to improve the sense of clicking the key buttons 221. Reflective patterns 211 are locally formed around the pressing protrusions 212. The light guide plate 210 may have various shapes. The light guide plate 210 guides the light irradiated there into.

The light irradiated into the light guide plate 210 travels from one side of the light guide plate 210 to the other side of the light guide plate 210 through total reflection in a boundary between the light guide plate 210 and an air layer outside the light guide plate 210. A conventional light guide plate may be manufactured by injection molding on polycarbonate or acryl-based resin having high permeability with respect to visible rays. However, the light guide plate 210 according to this embodiment of the present invention may be formed of a high-transparency rubber material such as polyurethane or silicon to enable key manipulation.

Each of the plurality of reflective patterns 211 reflects a part of the light going into the light guide plate 210 to the key button 221. The light going into the light guide plate 210 through total reflection is incident to the reflective patterns 211. Most of the light going to the key button 221 through diffused reflection by the reflective patterns 211 passes through the key button 221 and is irradiated to outside because of not satisfying a total reflection condition that an incident angle is smaller than a critical angle. The reflective patterns 211 implement uniform illumination on the key button 221 through diffused reflection in a random direction. The reflective patterns 211 may be formed by scratch or printing. When the light guide plate 210 includes an optical fiber array, the reflective patterns 211 extend from the bottom of the optical fiber array to the surface of cores.

On the other hand, the light passing without diffused reflection by the reflective patterns 211 and a part of the light undergoing diffused reflection go into the light guide plate 210. Thus, a part of the light going into the light guide plate illuminates other key buttons 221 and most of the remaining of the light is emitted to the other side of the light guide plate 210. The emitted light is incident to the light guide plate 210 after being reflected by the reflective layers 233.

The adhesive 204 is applied between the top surface of the light guide plate 210 and the pad 230 facing the top surface of the light guide plate 210 to adhere the pad 230 and the light guide plate 210 to each other. The light guide plate 210 is inserted into and fixed to the pad 230 whose bottom is opened in such a way that the sides of the light guide plate 210 face the sidewalls 234 of the pad 230.

In the keypad assembly 200, a PCB in a plate form and a switch board including a plurality of switches formed on the surface of the PCB facing the keypad 220 are combined to deliver the press of a key button to a switch and form an electric contact. Each of the plurality of switches may include a conductive contact member and a conductive dome entirely covering the contact member.

When a user presses the key button 221, the pressing protrusions 212 of the keypad 220 under the key button 221 are pressed toward the switch board 120, causing the pressing protrusions 212 to press a corresponding dome. The pressed dome then forms an electric contact with a corresponding contact member.

Figure 5:
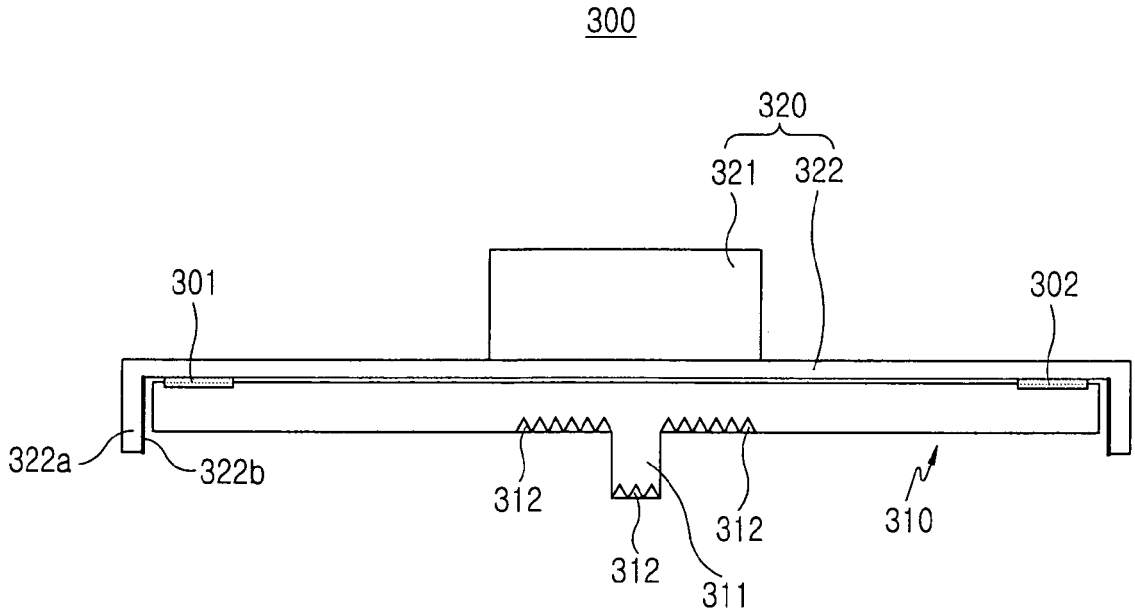
FIG. 5 is a cross-sectional view of a keypad assembly according to a second embodiment of the present invention.

FIG. 5 is a cross-sectional view of a keypad assembly 300 according to a second embodiment of the present invention. The keypad assembly 300 includes a keypad 320, a light guide plate 310, and an adhesive 301.

The keypad 320 includes sidewalls 322*a* extending downward, a pad 322 in the shape of a box whose bottom is opened, reflective layers 322*b* formed at the sidewalls 322*a* to face sides of the light guide plate 310, and at least one key buttons 321 placed on the pad 322.

The pad 322 may be formed of polyurethane or silicon having elasticity for restoring the pressed key button 321 to its original state. The pad 322 is adhered to the light guide plate 310 by the adhesive 301 applied on a part of the surface of the light guide plate 310.

The key button 321 is placed on the pad 322 in the shape of a flat plate. Parts of the sidewalls 322*a* are opened and light sources (not shown) and the light guide plate 310 are combined at the opened parts.

The light guide plate 310 includes pressing protrusions 311 for improving the sense of clicking the key buttons 321 and reflective patterns 312 around the pressing protrusions 311.

Figure 6:
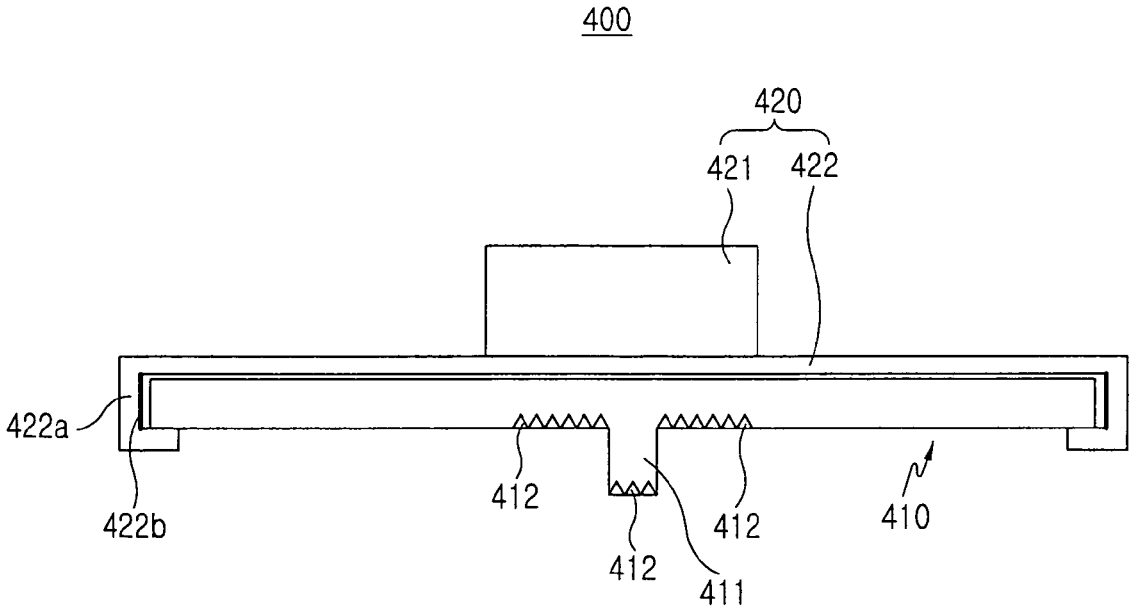
FIG. 6 is a cross-sectional view of a keypad assembly according to a third embodiment of the present invention.

FIG. 6 is a cross-sectional view of a keypad assembly 400 according to a third embodiment of the present invention. The keypad assembly 400 includes a keypad 420 and a light guide plate 410.

The keypad 420 includes sidewalls 422*a* extending downward, a pad 422 in the shape of a box whose bottom is opened, reflective layers 422*b* formed at the sidewalls 322*a* to face sides of the light guide plate 410, and at least one key buttons 421 placed on the pad 422.

The pad 422 may be formed of polyurethane or silicon having elasticity and its one end is bent to support the light guide plate 410.

The light guide plate 410 includes pressing protrusions 411 for improving the sense of clicking the key buttons 421 and reflective patterns 412 around the pressing protrusions 411.

Figure 7:
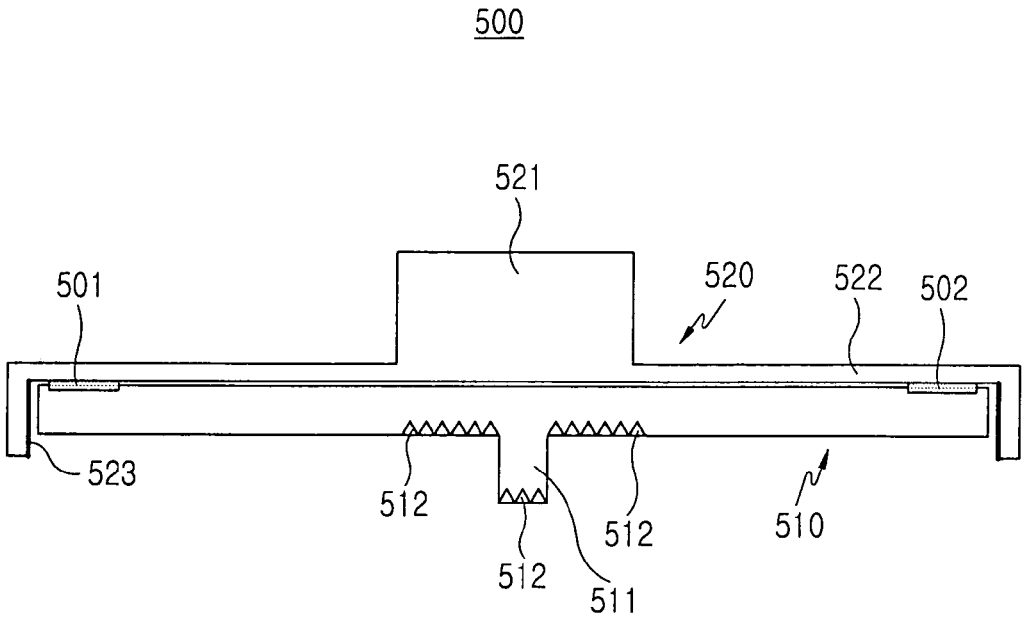
FIG. 7 is a cross-sectional view of a keypad assembly according to a fourth embodiment of the present invention.

FIG. 7 is a cross-sectional view of a keypad assembly 500 according to a fourth embodiment of the present invention. The keypad assembly 500 includes a keypad 520 and a light guide plate 510.

The keypad 520 includes a pad 522 that includes sidewalls extending downward and is in the shape of a box whose bottom is opened, reflective layers 523 formed at the sidewalls to face sides of the light guide plate 510, and at least one key buttons 521 integrated with the pad 522. The keypad 520 may be formed of polyurethane or silicon having elasticity.

The light guide plate 510 includes pressing protrusions 511 for improving the sense of clicking the key buttons 521 and reflective patterns 512 around the pressing protrusions 511. The light guide plate 510 and the keypad are adhered by adhesives 501 and 502.

Figure 8:
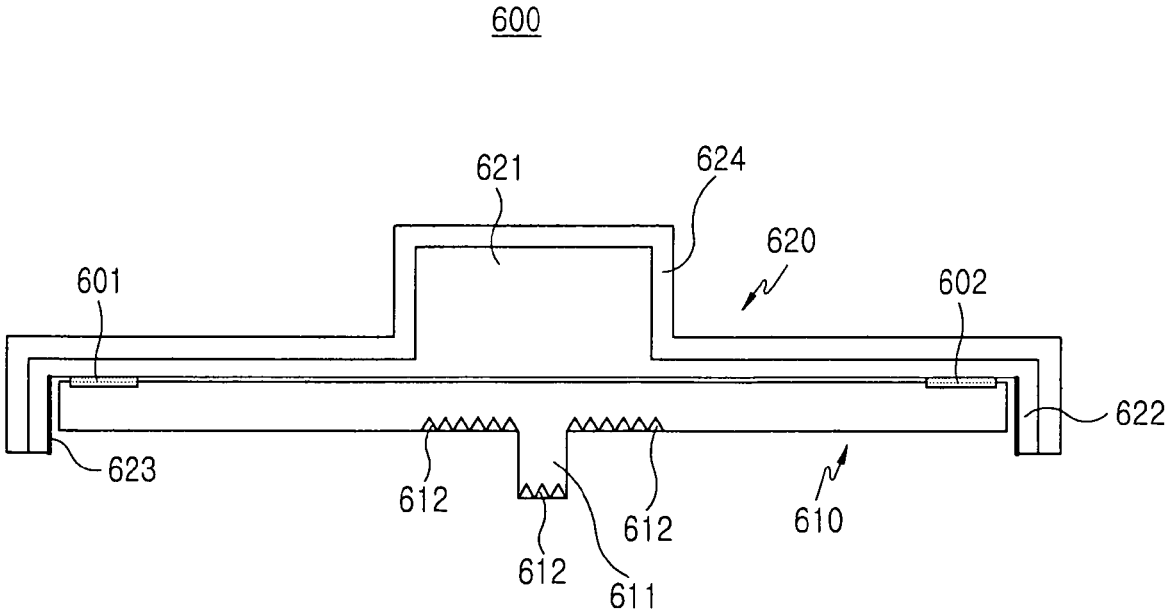
FIG. 8 is a cross-sectional view of a keypad assembly according to a fifth embodiment of the present invention.

FIG. 8 is a cross-sectional view of a keypad assembly 600 according to a fifth embodiment of the present invention. The keypad assembly 600 includes a keypad 620 that is integrated with key buttons 621 and includes a silicon layer 622 and a light guide plate 610.

The keypad 620 includes sidewalls extending downward and is in the shape of a box whose bottom is opened. The keypad 620 includes reflective layers 623 formed at sidewalls of the silicon layer 622 to face sides of the light guide plate 610 and a polyurethane layer 624 formed to contact the exterior surface of the silicon layer 622.

The light guide plate 610 includes pressing protrusions 611 for improving the sense of clicking the key buttons 621 and reflective patterns 612 around the pressing protrusions 611. The light guide plate 610 and the keypad 620 are adhered by adhesives 601 and 602.

Figure 9:
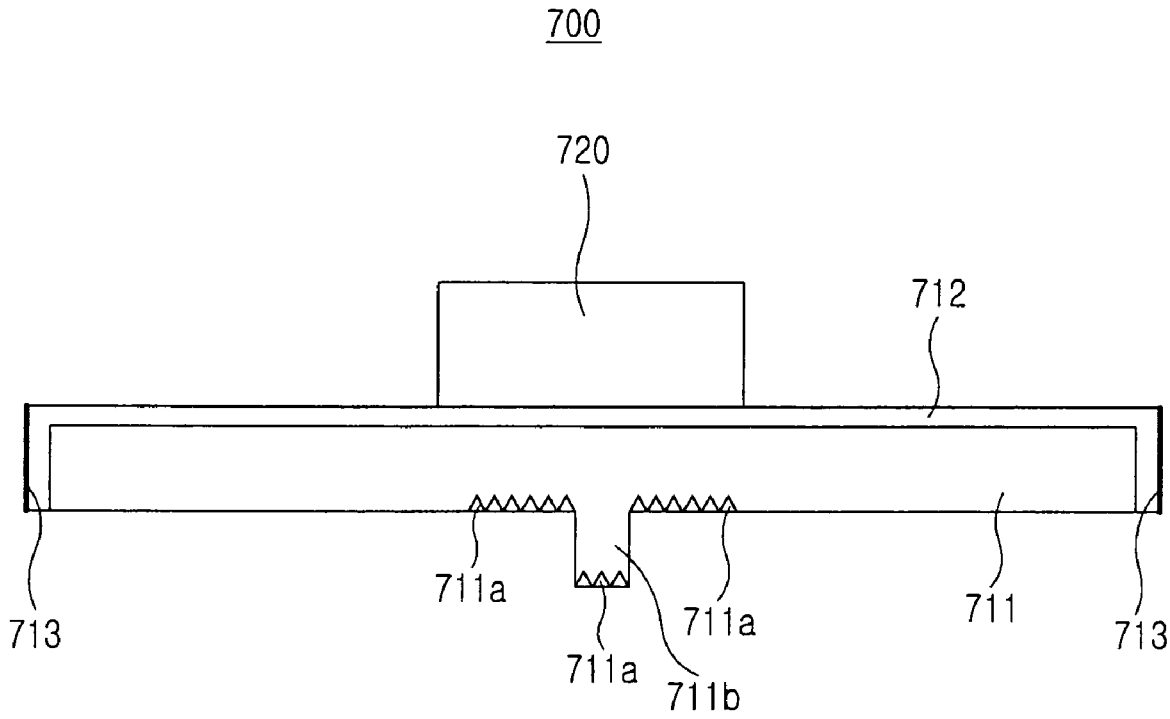
FIG. 9 is a cross-sectional view of a keypad assembly according to a sixth embodiment of the present invention.

FIG. 9 is a cross-sectional view of a keypad assembly 700 according to a sixth embodiment of the present invention. The keypad assembly 700 includes a light guide plate 711 on whose bottom surface pressing protrusions 711*b* and reflective patterns 711*a* are formed, and a pad 712 integrated with the light guide plate 711 to surround the remaining portions of the light guide plate 711 except for the bottom surface of the light guide plate 711. The keypad assembly 700 also includes at least one key button 720 placed on the top surface of the pad 712 and outputting light reflected from the reflective patterns 711*a* to their outside, and reflective layers 713 formed at sidewalls of the pad 712 facing sides of the light guide plate 711 to reflect light irradiated from the sides of the light guide plate 711 back to the sides of the light guide plate 711.

While the invention has been shown and described with reference to embodiments thereof, it will be understood by those skilled in the art that various changes in form and details may be made therein without departing from the spirit and scope of the invention.

What is claimed is:

1. A keypad assembly comprising:

a light guide plate including reflective patterns formed on a bottom surface of the light guide plate to reflect a part of light going into the light guide plate to a top surface of the light guide plate;

a keypad including a pad that has a bottom that is opened by sidewalls and surrounds the remaining portions of the light guide plate except for the bottom surface of the light guide plate and at least one key button placed on a top surface of the pad which outputs light reflected from the reflective patterns; and reflective layers formed at the sidewalls of the pad facing the sides of the light guide plate to reflect light back to the sides of the light guide plate, wherein the reflective layers includes a white printed layer facing a side of the light guide plate and a black printed layer in contact with a sidewall of the pad.

2. The keypad assembly of claim 1, further comprising an adhesive applied between the top surface of the light guide plate and the pad facing the top surface of the light guide plate to adhere the pad and the light guide plate to each other.

3. The keypad assembly of claim 1, wherein the pad includes a polyurethane layer.

4. The keypad assembly of claim 1, wherein the pad includes a silicon layer.

5. The keypad assembly of claim 3, wherein the pad further includes a silicon layer formed in the inner circumference of the polyurethane layer.

6. The keypad assembly of claim 1, further comprising pressing protrusions protruding from a portion of the bottom surface of the light guide plate where the reflective patterns are formed.

7. A keypad assembly comprising:

a light guide plate including reflective patterns that are formed on a bottom surface of the light guide plate to reflect a part of light going into the light guide plate to a top surface of the light guide plate; and a keypad including at least one key button which output light reflected from the reflective patterns, wherein the keypad further comprises:

a pad that is in the shape of a box whose bottom is opened by sidewalls, surrounds the remaining portions of the light guide plate except for the bottom surface of the light guide plate, and has the key buttons placed thereon; and reflective layers formed at the sidewalls of the pad facing the sides of the light guide plate to reflect light back to the sides of the light guide plate, wherein the reflective layers includes a white printed layer facing a side of the light guide plate and a black printed layer in contact with a sidewall of the pad.

* * * * *